US006513243B1

(12) United States Patent
Bignucolo et al.

(10) Patent No.: US 6,513,243 B1
(45) Date of Patent: Feb. 4, 2003

(54) METHOD OF PRODUCING FRONT AXLES FOR INDUSTRIAL VEHICLES

(75) Inventors: Roberto Bignucolo, Val Della Torre (IT); Daniele Di Bona, Turin (IT)

(73) Assignee: Iveco Fiat S.p.A. (IT)

( * ) Notice: Subject to any disclaimer, the term of this patent is extended or adjusted under 35 U.S.C. 154(b) by 5 days.

(21) Appl. No.: 09/880,086

(22) Filed: Jun. 14, 2001

(30) Foreign Application Priority Data

Jun. 16, 2000 (IT) ..... TO00A0585

(51) Int. Cl.[7] ..... B21D 53/88
(52) U.S. Cl. ..... 29/897.2; 29/421.1; 72/61
(58) Field of Search ..... 29/897, 897.2, 29/897.3, 421.1, 897.33, 525.14; 72/61, 370.06, 370.1, 370.26, 370.23

(56) References Cited

U.S. PATENT DOCUMENTS

| | | | | |
|---|---|---|---|---|
| 3,564,896 | A | * | 2/1971 | Clark et al. |
| 3,583,188 | A | * | 6/1971 | Nakamura |
| 3,793,703 | A | * | 2/1974 | Winkler et al. |
| 4,567,743 | A | | 2/1986 | Cudini |
| 5,333,775 | A | * | 8/1994 | Bruggemann et al. |
| 5,481,892 | A | | 1/1996 | Roper et al. |
| 5,499,520 | A | | 3/1996 | Roper |
| 6,016,603 | A | | 1/2000 | Marando et al. |
| 6,122,948 | A | * | 9/2000 | Moses |
| 6,182,487 | B1 | * | 2/2001 | Komiya et al. |
| 6,230,540 | B1 | * | 5/2001 | Wilch et al. |

FOREIGN PATENT DOCUMENTS

| | | | |
|---|---|---|---|
| DE | 3742717 | * | 2/1989 |
| EP | 0294034 | | 12/1988 |
| EP | 0588528 | | 3/1994 |
| EP | 0760265 | | 3/1997 |
| EP | 0414545 | | 2/1998 |
| EP | 0913277 | | 5/1999 |
| GB | 2068857 | | 8/1981 |

OTHER PUBLICATIONS

EPO Search Report Dated Sep. 18, 2001.

* cited by examiner

*Primary Examiner*—Gregory M. Vidovich
*Assistant Examiner*—T. Nguyen
(74) *Attorney, Agent, or Firm*—Hall, Priddy, Myers & Vande Sande

(57) ABSTRACT

A method of producing hollow front axles industrial vehicles including the steps of fluoforming a tubular blank to obtain an intermediate product having reduced-diameter ends, crushing the intermediate product to obtain a central portion of elongated section and bent intermediate portions, and finishing the axle by hydroforming.

10 Claims, 5 Drawing Sheets

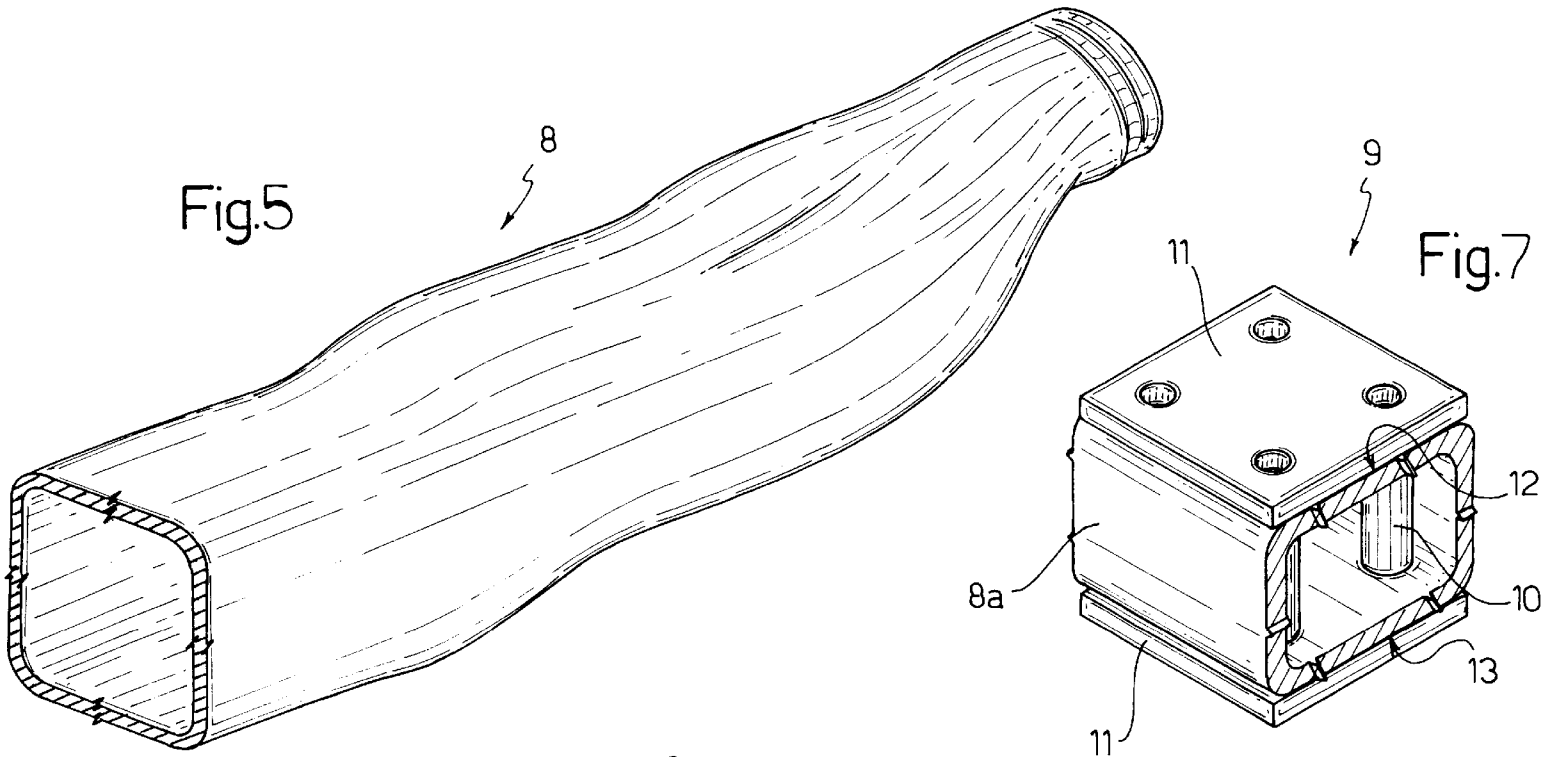
Fig.7
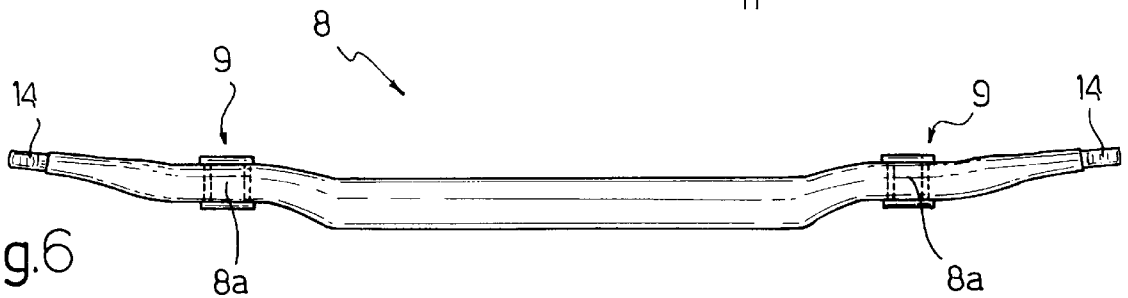
Fig.6
Fig.5

METHOD OF PRODUCING FRONT AXLES FOR INDUSTRIAL VEHICLES

The present invention relates to a method of producing front axles for industrial vehicles.

BACKGROUND OF THE INVENTION

At present, in the development of road vehicles, particularly industrial vehicles, increasing attention is being given to reducing the environmental impact and fuel saving which can be achieved by way of reduced consumption. From this point of view, one of the principal objects of the road vehicle industry is to improve the performance/weight ratio of vehicles.

A decrease in the weight of vehicles could be obtained by using lighter materials for some components of the vehicle, for example magnesium or aluminum alloys instead of conventional steels. However, this approach is not possible for certain applications in which the component is subject to heavy mechanical loading, for example in the case of axles.

At present, front axles comprise solid-section beams produced by a forging or casting process. Although axles of this type have satisfactory mechanical characteristics, they are, nevertheless, of particularly high weight and, for the above-mentioned reasons, they contribute in a not insignificant manner to the total weight of the vehicle and, therefore, to consumption and emissions.

The above-mentioned drawback could be obviated by using special non-ferrous alloys (for example, titanium) which are lighter and have high mechanical strength; however, such materials are very expensive.

Attempts have been made to produce hollow-section front axles by using non-conventional manufacturing processes such us hydroforming; however, these processes are very difficult to control and have substantial limitations as to the shape of the hollow body to be produced; in particular, known hydroforming processes can be used to obtain substantially straight tubular shapes, but cannot be used to produce shaped front axles having inclined or bent end portions, as is normally necessary in order to allow the axle to be housed below the engine of the vehicle. Therefore, to the applicant's knowledge, hydroformed axles have never been industrially successful.

SUMMARY OF THE INVENTION

The object of the present invention is to devise a method of producing front axles for industrial vehicles, which makes it possible to solve the problems of the prior art, and which allows, in particular, to produce shaped hollow front axles in a simple and economical manner.

This object is achieved by the present invention in that it relates to a method of producing front axles for industrial vehicles, characterized by comprising the steps of:

providing a tubular blank;

forming end portions of said tubular blank so as to obtain a first axis-symmetrical intermediate product having a central portion with the same diameter as said blank, reduced-diameter ends and tapered portions connecting said central portion to said ends;

crushing said first intermediate product so as to obtain a second intermediate product having a central portion with an elongated cross section and intermediate portions connecting said central portion to said ends and having a cross section evolving from elongated to substantially round; and finishing said axle by means of at least one forming step carried out by hydroforming.

BRIEF DESCRIPTION OF THE DRAWINGS

Further features of the present invention will become apparent from the following description of two non-restrictive embodiments thereof, with reference to the accompanying drawings, wherein:

FIGS. 2,3,4 and 5 are views corresponding to that in FIG. 1 and showing intermediate products obtained with successive steps of the method of the invention;

FIG. 6 illustrates on a reduced scale a front axle for a industrial vehicle obtained from the method forming of the invention;

FIG. 7 is a perspective, enlarged-scale view of a detail of the axle illustrated in FIG. 6;

DETAILED DESCRIPTION OF THE INVENTION

Figure 1:
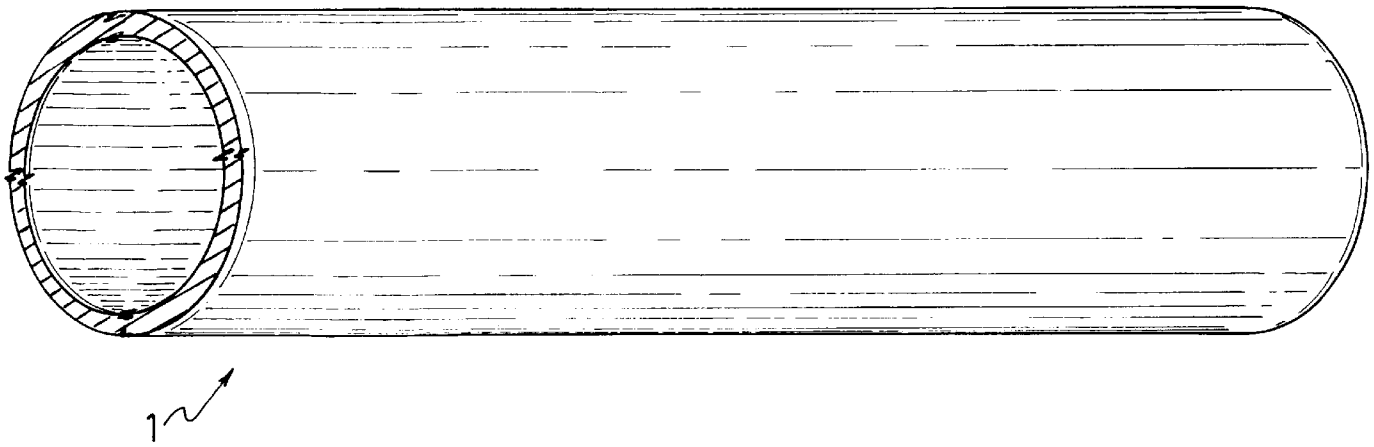
FIG. 1 is a partial perspective view of a tubular blank used as the starting material for a first preferred embodiment of the method of the invention.

According to a first preferred embodiment, the method forming the subject-matter of the invention provides a first preforming operation carried out by fluoforming a blank constituted by a tube of circular section denoted by the reference numeral 1 in FIG. 1. Tube 1 is conveniently obtained by cylindrically bending and longitudinally welding sheet metal. The term fluoforming signifies mechanical processing by plastic deformation of an axially symmetrical blank caused to rotate about its own axis by a radial force applied to the blank by way of one or more tools, typically rollers.

Once the fluoforming step has ended, a hollow first intermediate product 2 is obtained (FIG. 2), which has a cylindrical central portion 3 of a diameter equal to that of the original tube 1, two cylindrical ends 4 coaxial to the central portion 3 and having a smaller diameter than that of the central portion 3, and two intermediate frustoconical portions 5 integrally connecting the respective ends 4 to the central portion 3. subsequently, the first intermediate product 2 undergoes a second preforming operation which comprises pressing or "crushing" the semifinished product 2 in a press with relatively low closing forces. Following the above-described second preforming operation a second intermediate product 6 is obtained (FIG. 3), which has a central portion 3 of substantially elliptical cross-section 6*b* which is elongate in a horizontal direction and with the portions 4 and 5 symmetrically inclined or bent upwards with respect to the central portion 3, and it is provided with respective longitudinal impressions 6*a* having their maximum depth at the ends of the central portion 3 in the vicinity of the frustoconical portions 5.

The second intermediate product 6 is subsequently inserted inside a finishing die (not shown) and undergoes a third preforming operation in which the semifinished product 6 is compressed mechanically against the walls of the die so as to assume a three-dimensional configuration close to that of the finished axle. In this way there is obtained a semifinished product 7 (FIG. 4) which is of quadrangular cross-section 7*a* in the central portion 3 and which has transitional portions 7*b* in which the quadrangular section gradually evolves towards the ends 4, the section of which remains circular.

The semifinished product 7 subsequently undergoes a hydroforming step suitably carried out inside the finishing die. In particular, hydroforming signifies a process by means of which a hollow semifinished product is subjected in a die to a high internal hydrostatic pressure, of the order of thousands of bar, so as to adhere to the walls of the die.

By means of the above-described hydroforming step there is obtained a finished axle 8 which is illustrated partly in FIG. 5 and completely in FIG. 6.

Finally, as illustrated in FIG. 6, two reinforcing devices 9 are mounted on the finished axle 8, which are each arranged symmetrically in the vicinity of respective intermediate lateral portions 8*a* of the axle 8 and provide for connecting the axle to respective suspensions, e.g. leaf springs (known but now shown), In particular, as shown in FIG. 7, for the connection to respective leaf springs, each of the reinforcing devices 9 comprises four bushes 10 arranged vertically and passing through the axle 8, and a pair of plates 11 welded on to the upper and lower walls 12 and 13 of the axle 8, with which the bushes 10 co-operate axially. The above-described connecting devices 9 enable the axle 8 to be secured to the leaf springs by means of pairs of U-bolts of conventional type, providing the required mechanical strength for the axle 8, in particular against crushing in a vertical direction.

Ends 4 of the finished axle are adapted to be welded to end supports 14 for pivotal connection of respective wheel assemblies.

Figure 8:
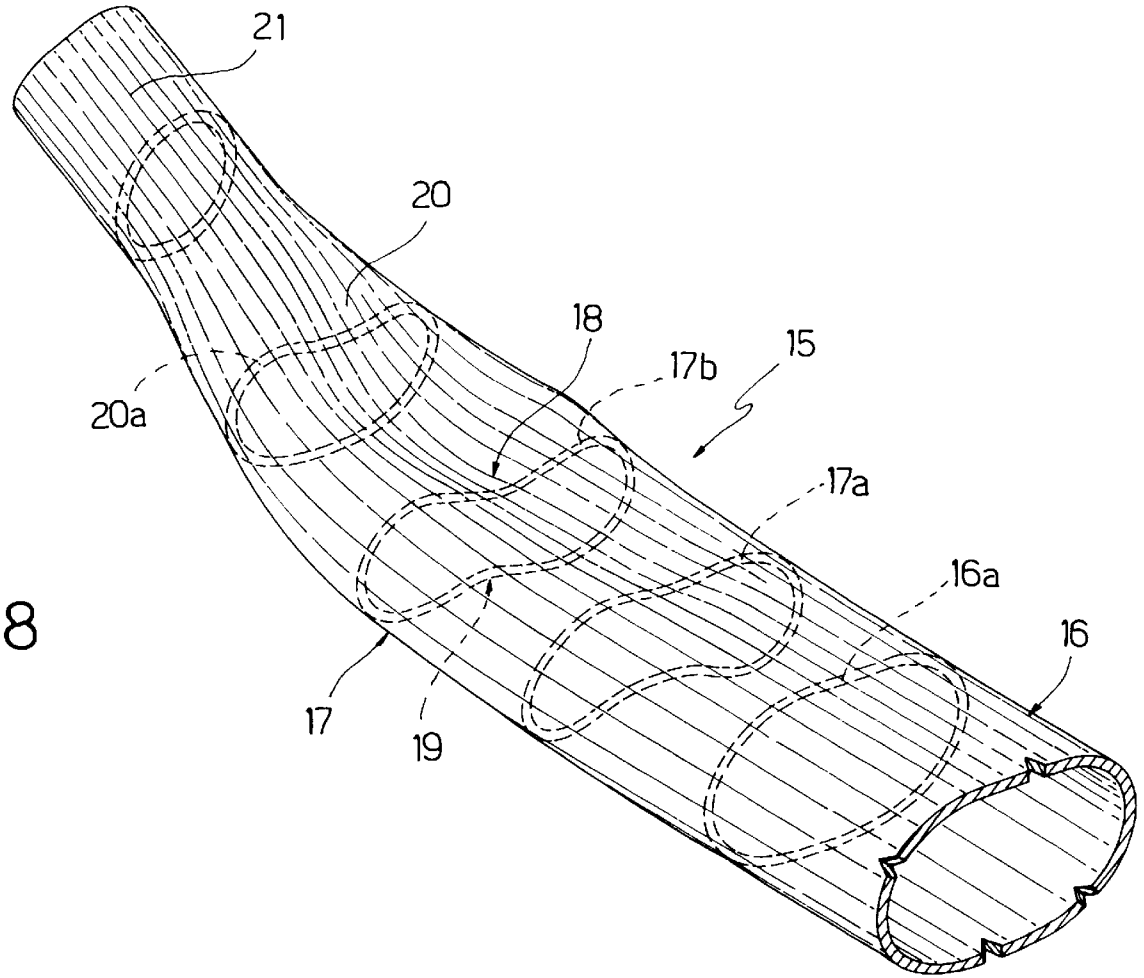
FIG. 8 is a partial perspective view of an intermediate product obtained by a second embodiment of the method according the present invention.
Figure 9:
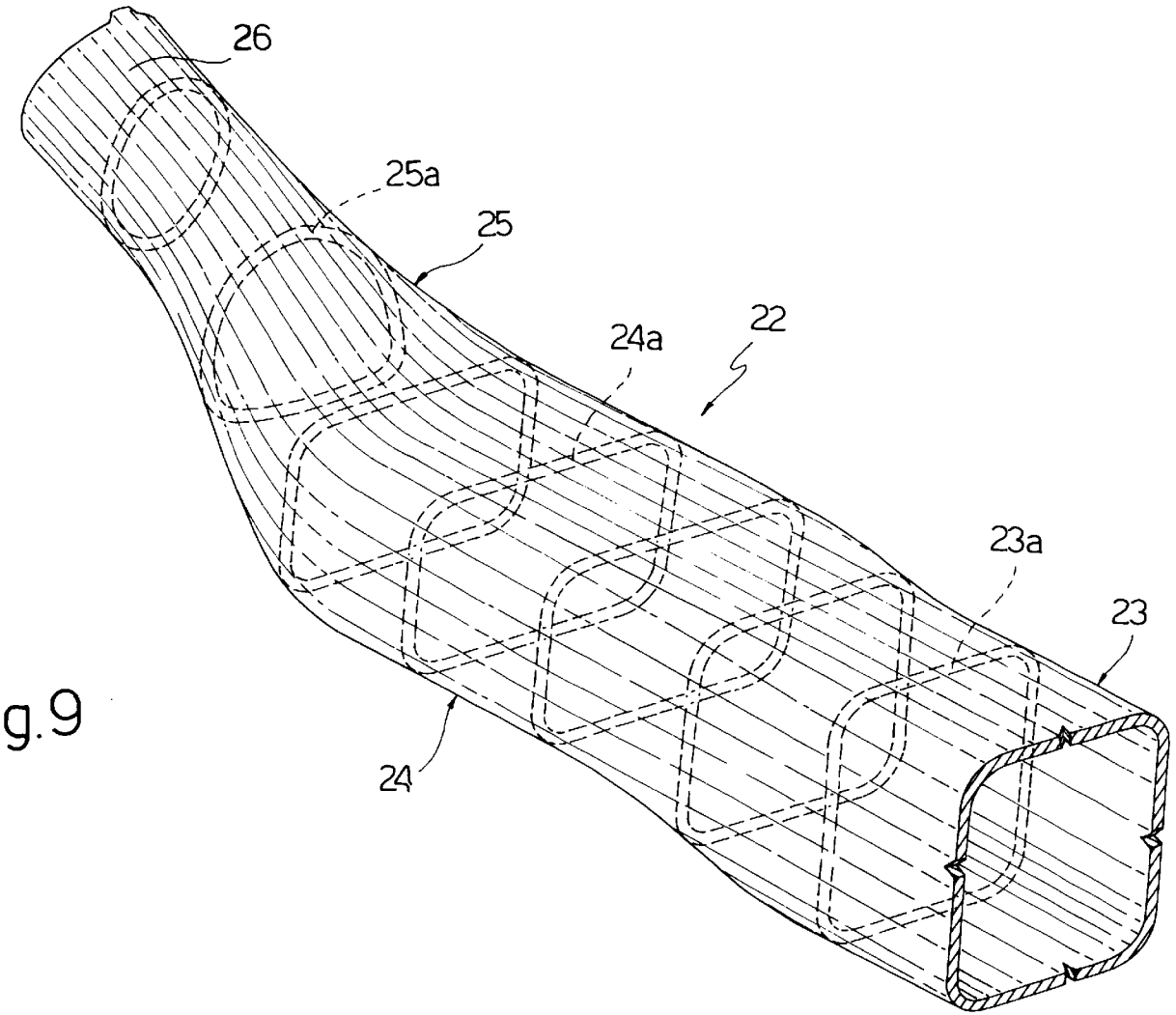
FIG. 9 is a partial perspective view of a finished front axle obtained from the intermediate product of FIG. 8.

FIGS. 8 and 9 show different steps of a second embodiment of a method according to the present invention. The first steps of this method substantially correspond to what disclosed in FIGS. 1 and 2 and the corresponding part of the description.

Figure 2:
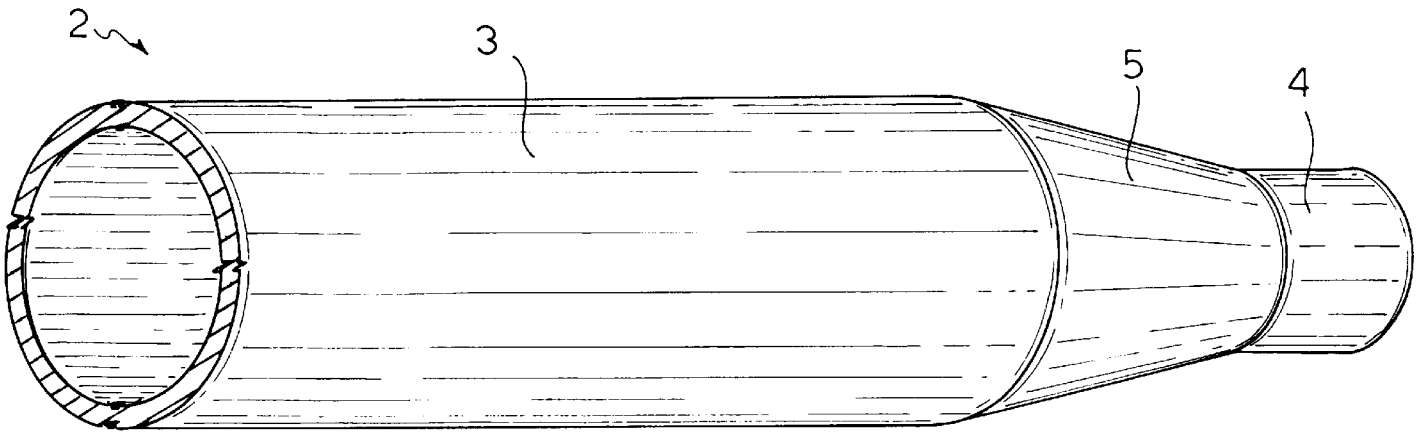
Figures 3, 4:
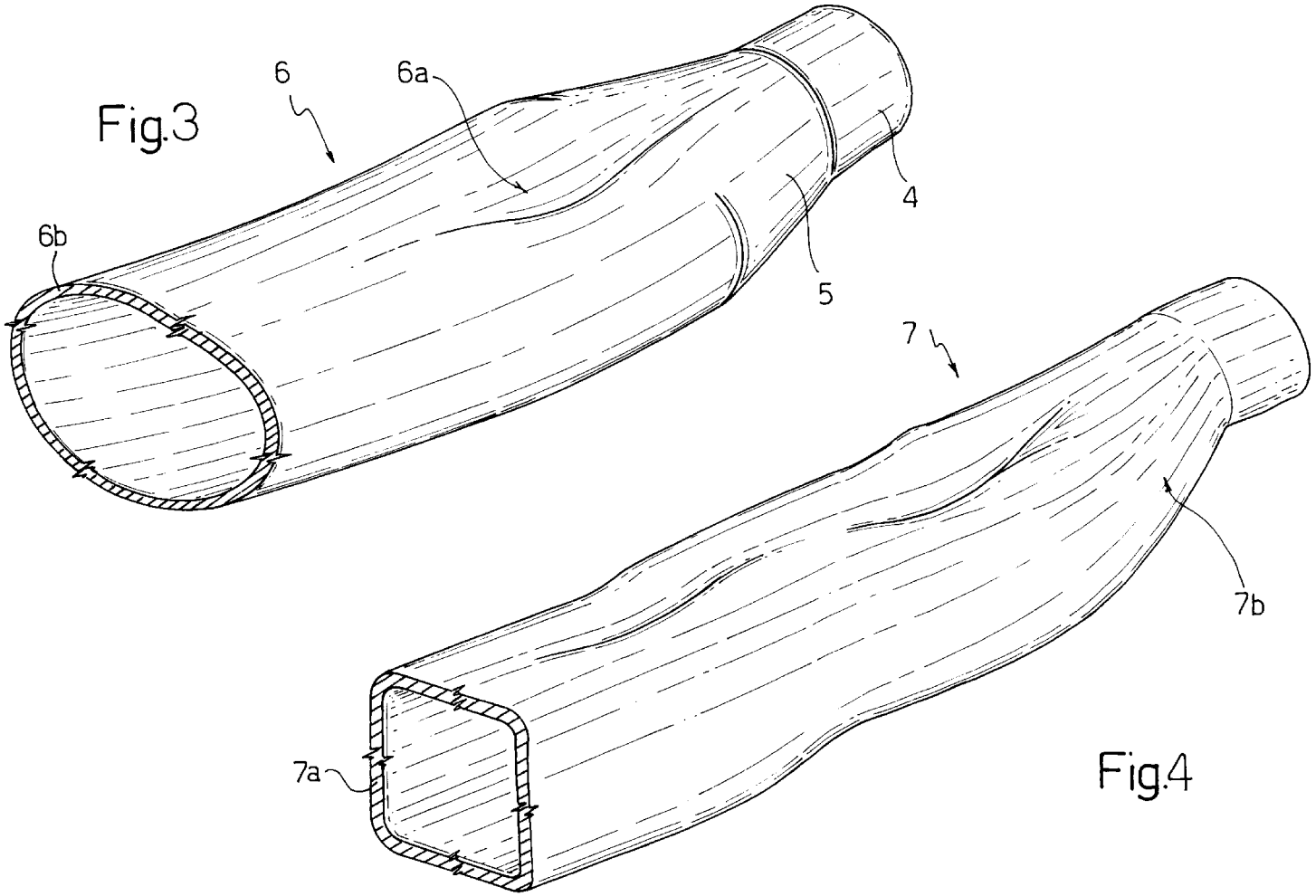

FIG. 8 corresponds to FIG. 3 and shows in greater detail the different cross sections of the intermediate product 15 obtained after the crushing operation. As can be clearly seen, the intermediate product 15 comprises a central part 16 having an horizontally elongated and substantially elliptical cross-section with top and bottom flat surfaces, and which is shorter than the original cylindrical central portion 3 (FIG. 2); the cross section gradually evolves from central part 16 into intermediate lateral portions 17, corresponding to end sections of the original central portion 3, which are wider and lower than central portion 16 and have top and bottom longitudinal depressions 18, 19, so that the cross section is concave upward and downward and convex laterally (see cross-sections 17*a*, 17*b* in FIG. 8). Intermediate product 15 further includes lateral tapered portions 20 which substantially correspond to frustoconical portions 5 of FIG. 2, are inclined upwards with respect to parts 16, 17 and have a convex bottom profile (see cross-section 20*a*) and an upper profile evolving from concave to convex towards end portions 21 which remain cylindrical.

FIG. 9 shows the final shape of the finished axle 22 obtained by means of a finishing step, which is carried out in a hydroforming die in which the workpiece is subjected to an internal hydrostatic pressure and, at the same time, transversally compressed by means of a mechanical force.

The finished axle 22 includes a central portion 23 having a substantially square cross section 23*a* with rounded corners and, proceeding towards the axle ends, raised intermediate portions 24 having a rectangular, horizontally elongated cross section 24*a* with rounded corners, upwardly inclined tapered portions 25 having a cross section which gradually evolves from rectangular to round maintaining initially a substantially flat bottom surface (see cross section 25*a*), and round ends 26. The top surfaces of portions 23 and 24 are conveniently coplanar.

Additional element such as leaf spring connecting devices 9 and wheel assembly end supports 14 are finally fitted to the finished axle 22.

It is evident how the method of the invention makes it possible to produce hollow-bodied axles of particularly low weight, without thereby compromising their rigidity or mechanical strength, also when the axle is shaped, and without the necessity of having to use expensive special materials.

Furthermore, it is important to note that, by means of the combined stamping and hydroforming steps, the method of the present invention makes it possible to obtain a hollow axle without any need for assembly processes involving welding, riveting or the like, which can weaken the axles structurally and give rise to possible cracks.

Finally, it is evident that the method described can be subject to modifications and variants which do not depart from the scope of protection of the claims.

What is claimed is:

1. A method of producing a front axle for industrial vehicles, characterised by comprising the steps of:

providing a tubular blank;

forming end portions of said tubular blank so as to obtain a first axis-symmetrical intermediate product having a first central portion with the same diameter as said blank, reduced-diameter ends and tapered portions connecting said first central portion to said ends;

crushing said first intermediate product so as to obtain a second intermediate product having a second central portion with an elongated cross section and intermediate portions connecting said second central portion to said ends and having a cross section evolving from elongated to substantially round; and finishing said second intermediate product by means of at least one forming step carried out by hydroforming thereby forming said front axle.

2. A method as claimed in claim 1, characterised in that said step of forming said end portions of said tubular blank is carried out by fluoforming.

3. A method according to claim 1, characterised in that said tubular blank is obtained by cylindrically bending and longitudinally welding sheet metal.

4. A method as claimed in claim 1, characterised in that said crushing operation creates in said second intermediate product longitudinal impressions extending at least along said intermediate portions, said intermediate portions being bent upwards in relation to said second central portion.

5. A method as claimed in claim 4, characterised in that said longitudinal impressions are provided on top and bottom surfaces of said intermediate portions of said second intermediate product.

6. A method as claimed in claim 1, characterised in that said finishing step comprises a mechanical pressing step carried out in the same finishing die as said hydroforming step.

7. A method as claimed in claim 6, characterised in that said mechanical pressing step and said hydroforming step are performed simultaneously.

8. A method as claimed in claim 1, characterised in that said finishing step produces a third central portion of said axle having a quadrangular cross section with rounded corners.

9. A method according to claim 1, characterised by comprising the step of mounting on the axle a pair of reinforcing devices provided with means for connecting said axle to respective suspensions.

10. A method according to claim 9, characterised in that said devices each comprise a plurality of bushes mounted through the axle and a pair of plates fixed to opposite walls of the axle and with which said bushes co-operate axially.

* * * * *